United States Patent [19]

Raman et al.

[11] 4,394,332

[45] Jul. 19, 1983

[54] CRUCIBLELESS PREPARATION OF RAPIDLY SOLIDIFIED FINE PARTICULATES

[75] Inventors: Ramaswamy V. Raman; Robert S. Carbonara, both of Columbus, Ohio

[73] Assignee: Battelle Memorial Institute, Columbus, Ohio

[21] Appl. No.: 316,003

[22] Filed: Oct. 29, 1981

Related U.S. Application Data

[63] Continuation of Ser. No. 163,907, Jun. 27, 1980, abandoned.

[51] Int. Cl.[3] ..... B01J 2/06

[52] U.S. Cl. ..... 264/8

[58] Field of Search ..... 264/8

[56] References Cited

U.S. PATENT DOCUMENTS

| | | | |
|---|---|---|---|
| 1,782,038 | 11/1930 | Haak . | |
| 2,040,168 | 5/1936 | DeBats | 83/91 |
| 2,439,772 | 4/1948 | Gow | 264/8 |
| 3,041,672 | 7/1962 | Lyle | 264/10 |
| 3,320,338 | 5/1967 | Lemelson | 264/14 |
| 3,896,203 | 7/1975 | Maringer et al. | 264/165 |
| 4,124,664 | 11/1978 | Maringer | 264/8 |

FOREIGN PATENT DOCUMENTS

| | | |
|---|---|---|
| 1224125 | 9/1966 | Fed. Rep. of Germany . |
| 55-54508 | 4/1980 | Japan . |
| 55-64948 | 5/1980 | Japan . |

OTHER PUBLICATIONS

P. Duwez et al., "Continuous Series of Metastable Solutions in Silver-Copper Alloys", *J. Appl. Phys.*, 31, (1960), pp. 1136-1937.

R. Pond Jr. et al., "A Method of Producing Rapidly Solidified Filamentary Castings", *Trans. Met. Soc. AIME*, vol. 245, Nov. 1969, pp. 2475-1476.

331. Portion of "Japanese Association Collection of Talking Paper Draft Summary" (a.k.a. "Special Issue for the Toyama Meeting"), Eng. Transl. Title-Manufacture of lead filaments by a simple spinning method in which a rotating drum is used, distributed after Sep. 19, 1978, and by date of meeting on Oct. 3, 1978, by Japanese Metallurgy Association to members thereof.

*Primary Examiner*—James R. Hall

*Attorney, Agent, or Firm*—Kenneth R. Warburton

[57] ABSTRACT

A mass of normally solid material, e.g. metal or metal alloy, which at a temperature within 25 percent of its equilibrium melting point °K has a surface tension of 10 to 2500 dynes/cm. and a viscosity of 0.001 to 1 poise, is changed into fine solid particulates, preferably flake-like to almost spherical shape. A solid mass of the material has a portion thereof, e.g. tip or edge, unconfined by a crucible or the like, heated, such as by a flame or electron beam to alter that portion to a molten state whereby molten droplets or globules fall therefrom to contact a rapidly moving wall of a centrifugally disposed rotating liquid quench fluid, e.g. water or oil, and upon contacting are disrupted and broken up into finer globules or particles which are swept away with and quenched in the rapidly moving quench fluid to become rapidly solidified as fine particulates. These fine particulates subsequently are separated from the quench fluid and classified to find utility for example in powder metallurgical applications.

10 Claims, 1 Drawing Figure

CRUCIBLELESS PREPARATION OF RAPIDLY SOLIDIFIED FINE PARTICULATES

This application is a continuation of application Ser. No. 163,907, filed June 27, 1980, and now abandoned.

CROSS-REFERENCE TO RELATED APPLICATION

This application is cross-referenced to commonly assigned U.S. Ser. No. 163,908, of Ramaswamy V. Raman et al, entitled PREPARATION OF RAPIDLY SOLIDIFIED PARTICULATES being filed on even date herewith.

TECHNICAL FIELD

This invention relates to making of rapidly solidified fine particulates. More particularly, the invention concerns a method of making solid fine particulates through a portion of a mass of solid material being heated to a molten state, which is unconfined by any crucible or like container, so as to provide molten droplets or globules therefrom which fall therefrom to contact a centrifugally disposed rapidly rotating liquid quench fluid (i.e. quench liquid) whereat the falling molten droplets are disrupted and broken up into finer droplets and globules which are swept away in and rapidly quenched into the fine solid particulates which subsequently are recovered from the quench fluid.

BACKGROUND

P. Duwez et al. (J. Appl. Phys. 31, p 1136–37 (1960)) teaches a propelling of a small lquid metal alloy droplet against the target of the inside surface of a high speed rotating cylinder at a suitable angle with centrifugal force acting on the contacting droplet to insure good thermal contact with the target with a large over-all heat transfer rate and to spread the droplet into a thinner layer of solidified material. R. Pond, Jr. et al. (Trans. Met. Soc. AIME Vol. 245, p. 2475–2476, Nov. 1969) discloses casting of metallic fiber by forcing a stream of molten alloy through an orifice onto the inside surface of a spinning drum with the drum's radial acceleration inducing good thermal contact and a spreading of the contacting stream into a flat filament prior to complete solidification.

J. T. Gow (U.S. Pat. No. 2,439,772) uses a revolving container containing a cooling or quenching liquid which from the revolving is formed into an annular vertical wall of revolving liquid into which are thrown globules of molten metal at a substantially normal path thereto to penetrate the liquid rather than glance off. In this process Gow discharges a molten material (e.g. steel) stream into a rotating dish-shaped receptacle to throw metal from its periphery as the small globules being thrown into the annular vertical wall of revolving liquid. Gow in discussion of the prior art also mentions disintegrating molten metal in the form of a stream into droplets by means of impacting the molten metal stream with high pressure steam or water and another method of rapidly rotating drum or paddle wheels hitting a metal stream to throw or bat globules therefrom.

B. Haak (U.S. Pat. No. 1,782,038) converts salts into globular bodies through a melt being poured onto a rotating disc which throws therefrom droplets towards the walls of a vessel containing a rotating liquid the level of which is higher than the rotating disc by means of intense rotation by a stirrer.

R. E. Maringer et al (U.S. Pat. No. 3,896,203) teach forming a filamentary material by rotating a disk-like member in contact with an unconfined pendant drop of molten material, R. E. Maringer (U.S. Pat. No. 4,124,664) also teaches forming filamentary material from a pendant drop of molten material by employing a rotating disc. The drop and the disc are in contact constantly.

SUMMARY DISCLOSURE OF THE INVENTION

In general, the method of the invention involves a, somewhat freely suspended and devoid of a crucible or like containment vessel, mass of normally solid material at its lowermost end being heated to a molten mass so as to provide molten golbules or droplets which break off thereform. The molten globules or droplets descend and contact a centrifugally disposed rotating quench fluid (i.e. quench liquid). At the quench fluid the molten globules are broken up and/or disintegrated into numerous smaller size globules or particles. The numerous smaller size globules or particles enter into and are swept away by the quench fluid wherein they are rapidly quenched into solid particulates.

BRIEF DESCRIPTION OF THE DRAWING

Additional disclosure of the invention is apparent from the description of the accompanying drawing of which.

MORE DETAILED DESCRIPTION OF THE DRAWING

Figure 1:
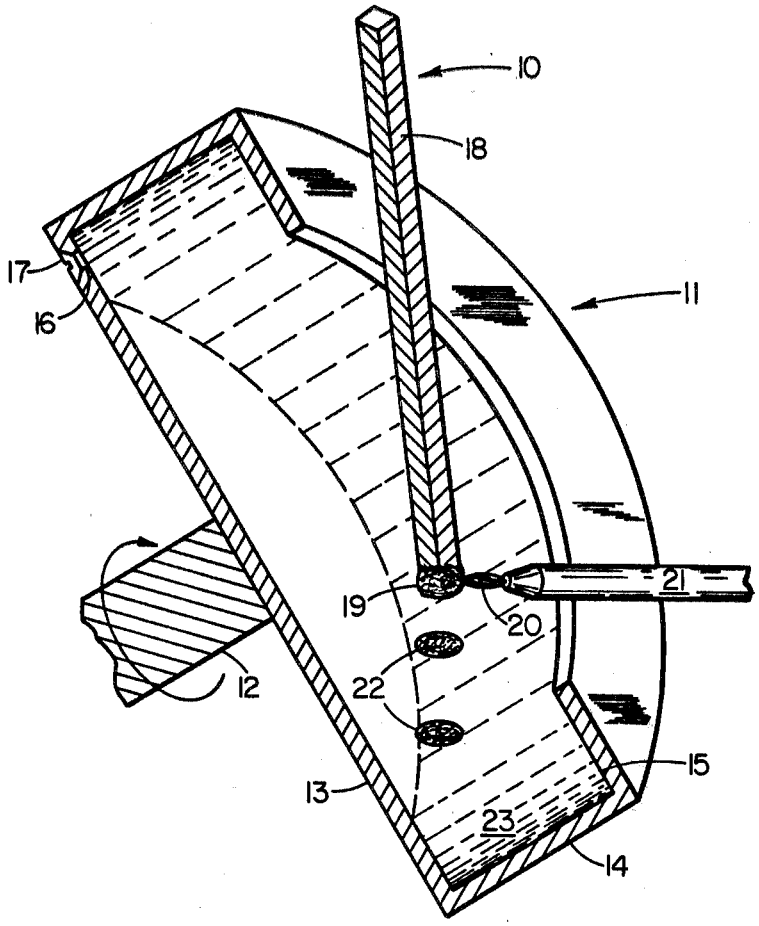
FIG. 1 is a perspective view partially in vertical cross-section and partially illustrated somewhat diagrammatically of one simplified form of apparatus useful for practice of the method of the invention.

A useful apparatus for practice of the invention is designated generally 10 in FIG. 1. Apparatus 10 includes a somewhat sideways turned cup-shaped element, generally designated 11, which has a shaft 12 centrally affixed to a bottom section 13. Shaft 12 is rotatable at any of a variety of chosen speeds by a conventional motor means, not illustrated. Bottom section 13 at its outer periphery merges into a projecting angularly therefrom, generally at about 90° or slightly less, cylindrical side wall 14 which at its upper portion merges into an inwardly projecting ring-like rim 15. Located in section 13 near side wall 14 there is a hole or opening 16 which has been closed by a means, such as a threaded machine screw 17.

In the circular opening encircled by ring-like rim 15 there is projecting a bar, rod, or ingot 18 of the material which is to be made into particulates. In the drawing this rod is shown suspended in mid-space, although in practice of the invention it would be clamped or held at one or more places away from its lowermost end portion 19 by a conventional clamping means and/or a movement means for progressively lowering or feeding bar 18 as lowermost portion 19 thereof is utilized or consumed. In the illustrated apparatus, a flame 20 from a torch 21, e.g. propane, heli-arc, or like conventional torch, has heated the lowermost end portion 19 of bar 18 into a molten bulbous-like molten mass. From the molten mass of lowermost end portion 19 there are shown dripping downward therefrom large globules 22 of the molten material to be formed into particulates.

Cup-shaped element 11, in operation of the method, contains within a quench fluid 23, which is disposed as a rapidly moving rotating wall of the quench fluid 23, clinging to the inside of side wall 14 of cup-shaped element 11 from centrifugal force imposed thereon by rapid rotation of shaft 12 and its attached cup-shaped element 11. The position relationship of lowermost end portion 19 of bar 18 and the quench fluid 23 is such that large molten globules 22 as they drip from end portion 19 descend downwardly to contact the rapidly moving rotating centrifugally disposed wall of the quench fluid 23.

Although not illustrated, apparatus 10 could be completely enclosed by a not-illustrated surrounding containment vessel or the like so as to provide, as desired, a reduced or evacuated pressure within cup-shaped element 11 and around bar end portion 19, or if desired an atmosphere of a particular gas, such as an inert gas of argon, helium, etc. or other gas.

At the conclusion of a preparation of fine solid particulates, the cup-shaped element 11 can be positioned with its hole or opening 16 and closure means of screw 17 at its lowermost rotatable level. Screw 17 then can be removed with the contents of liquid quench fluid 23 and produced particulates readily drained from element 11 for subsequent processing. In lieu of hole 16 and 17, an alternative, not illustrated, arrangement would be to have the entire cup-like element 11 affixed on a tiltable plate. In this arrangement the element 11 can be emptied by tilting and pouring.

DETAILED DISCLOSURE OF THE INVENTION

In practice of the invention, an unconfined portion of a mass of appropriate solid material is heated to a molten state to provide molten globules of material descending therefrom. Concurrently one provides a rapidly moving ring-like mass of a centrifugally disposed rotating appropriate liquid quench fluid (i.e. quench liquid). The positioning of the rapidly moving ring-like mass of the centrifugally disposed rotating liquid quench fluid to the descending molten globules is such that the globules contact a lower portion of an exposed inner surface of the moving ring-like mass of centrifugally disposed rotating liquid quench fluid. Upon contact there results a loud noise, an almost explosive-like sound, and the molten globules are disintegrated and broken up into numerous fragments. These fragments are quickly picked up and whisked away in the rapidly moving liquid quench fluid. Within the liquid quench fluid the fragments are cooled rapidly to fine solid particulates. These solid particulates subsequently can be separated by conventional means from the liquid quench fluid and find utility for a variety of purposes, including powder metallurgical applications.

In order for the invention's process to operate readily, the unconfined tip or equivalent portion of the solid mass which serves as the source of molten globules is positioned generally within space encompassed by the peripheral space circumscribed by the rapidly moving ring-like mass of the centrifugally disposed rotating liquid quench fluid. Generally the distance from the source of the molten droplets to travel to contact the moving quenchant is kept relatively short. With laboratory apparatuses, distances as close as 0.25 in. (0.635 cm.) are useful as well as distances as great as 1.0 inches (2.54 cm.). Preferred are distances of about 0.25 inches (0.635 cm.) to 0.5 in. (1.27 cm.), although preferred distances can vary greatly depending on various process parameters and specific materials employed. The size and shape of the produced particulates appear to be greatly influenced by the specific combinations of materials employed (i.e. specific quenchant and specific solid material source for the particulates) as well as specific combinations of method parameters. Of greatest influence on size and shape of produced fine solid particulates is deemed the speed of the moving quenchant upon contact with the molten globules. A minimum quenchant speed appears to be about 2500 rpm. or in the order of 3750 ft./min. (1140 m./sec.). At such speeds disintegration of the molten globule is at least a hundred-fold. Higher speeds apparently provide disintegration of globules into even larger numbers of fragments and also provide the finest size solid particulates. Maximum speed appears to be limited only by such factors as man-made fabrication techniques, safety factors, and the like.

In comparison to other known methods of preparation of rapidly solidified particulates, this invention's method provides numerous advantages. Substantially any liquid material or any material which can be placed in a liquid state is a candidate for the quench fluid, and particularly appropriate quench fluids can be selected for different molten materials which are being made into particulates. The employed surface speed of the centrifugally disposed wall of the liquid quenchant can be obtained easily and also readily changed to another speed, if desired, with good control on this speed and thus extremely precise control of the particle size of the produced particulates. The invention's centrifugal technique appears to be less costly than prior art techniques involving high speed pumping or other movement means for quenchants. Additionally the invention's centrifugal quenchant technique can provide more than adequate coolant capacity and temperature control. Upon the molten globules being broken into fine droplets from contacting the moving quenchant, the fragments or fine droplets pass immediately or very quickly enter the mass of moving liquid quenchant with extremely high quenching rates being obtained. Heat transfer from the molten metal particulates to cold quenched solid particulates proceeds substantially continuously while within the liquid quenchant. In addition a major problem, associated with conventional water atomization wherein an insulating steam layer prevents further cooling, is avoided in this invention's technique because of the rapid introduction and simultaneous movement of thick layer of quenchant and the trapped particulates. Additionally of great importance to the invention's process is that the material being made into particulates is molten only in an unconfined space and in its unconfined molten state does not contact a crucible or like vessel wherein often great care must be taken to avoid possible contamination or loss of purity in certain source materials prone to picking up impurities from vessels within which they are melted. Such impurities if picked up would be expected to carry over and be found in the produced particulates. Because of this significant advantage the present invention aptly can be deemed a crucibleless preparation of rapidly solidified particulates. Also the invention can be applied to certain highly reactive materials, for example metals and alloys of Ti, Zr, etc. for which no suitable crucible is available, because of the metal's tendency to react and degrade the crucible, and certain high melting materials, such as steel, refractory-based alloys, etc. for which a suitable crucible is either not available or, when available is very costly.

The cup-shaped element, which is rotated at high speed, generally is fabricated of a metal, for example, stainless steel, aluminum, molybdenum, copper, and the like. Because of the high rotational forces to which this rotating element is subjected, care must be used in its fabrication; its construction material and fabrication must be selected with regards to providing adequate strength to withstand the forces encountered during usage; its fabrication should include a very careful dynamic balancing so as to insure uniform rotation without vibration; and desirably the employed entire apparatus is surrounded by protective safety shields, and the like.

The non-illustrated holding and advancing means for the bar, rod, ingot or other shape of solid material of which an unconfined portion thereof is made molten to provide molten globules can be any of numerous conventional means known in the art such as, for example, means for holding and advancing of welding rods, or a synchronized metal feed system, and the like, with little to no modification of these means.

The employed liquid quench fluid (i.e. quench liquid) may be a pure liquid, a solution, a liquified gas at higher speeds or a solid-liquid dispersion. The quench fluid may be inert and chemically unreactive towards the molten material with which it is used, and generally is so. However, the invention does not exclude liquid quench fluids, which may react with the particularly employed molten material so long as such reaction primarily is of a surface skin reaction-type or of a coating of the particulates and is not significantly detrimental to disintegration and breaking up of the molten globules upon contacting the rapidly moving centrifugally disposed rotating liquid quench fluid.

The choice of particular quench fluid and its temperature is made in relation to the particularly employed material being made into particulates as well as other process parameters, such as the size of the molten globules and force of contact with the quench fluid and also as well as the depth or thickness of and movement speed of the rapidly moving centrifugally disposed rotating liquid quench fluid. Desirable qualities and properties for the quench fluid are that it possess a high thermal capacity, be non toxic, be relatively non-flammable, be of low cost, and the like. For example, water is quite useful for molten globules of many materials and with globules whose temperatures are as high as 2200° F. (1204° C.) and higher; likewise various lower temperature aqueous salt (e.g. NaCl, $MgCl_2$, $ZnCl_2$) brines can be used with some materials; petroleum and synthetic oils also are useful; liquified gases are contemplated as useful; etc. Almost any liquid quenchant or quench fluid may be used so long as it can be placed in the state of a rapidly moving centrifugally disposed rotating wall-like liquid mass possessing such density and kinetic movement and heat capacity so as to disintegrate and break up the particularly employed molten material globule. Particularly useful and preferred are the following liquid quenchants for various molten materials: cold water or mixture of brine and cold water for molten Fe, Ni, and other non-reacting transition metal alloys; inert fluids such as liquid helium for reactive materials; and oils with varying quenching speeds for particles produced at varying quench rates. Of course, the foregoing merely represent typical useful quench fluids, and a variety of alternative quench fluids also may be employed.

Although the molten material, which is formed into particulates, herein is described and illustrated in the specific illustrative examples with particularity as from a source material of a metal or metal alloy through melting of the same, the invention should be and is considered operable with any material possessing properties, in the molten state at temperatures reasonably close to its melting point, similar to those of molten metals. The molten material should have, at a temperature with 25 percent of its equilibrium melting point in °K., the following properties: a surface tension in the range of from 10 to 2,500 dynes/cm, a viscosity in the range of from $10^{-3}$ to 1 poise and reasonably discrete melting point (i.e. a discontinuous temperature versus viscosity curve). The present invention is deemed operable with most metals as well as chemical compounds, and elements meeting the above criteria. In addition, the present invention is operable with metal alloys even where such alloys display a wide temperature range between the first solidification of any component within the alloy (the liquidus temperature) and the temperature at which the lowest melting point compositions solidify (the solidus temperature) yielding a completely solid material. For purposes of definition, such an alloy would be "molten" only above the liquidus temperature even though there is some molten material present at a temperature between the liquidus and solidus temperatures.

The molten globules, which are formed into particulates by the invention's method, can be from melting by conventional heating means of: a metal, for example, aluminum, zinc, lead, tin, copper and the like; or from melting a metal alloy, for example, a predominantly nickel alloy such as $Ni_{63}Cr_{12}Fe_4B_{13}Si_8$, or $Fe_{40}Ni_{40}P_{14}B_6$, and the like; or from melting metastable alloy compositions, which are known to be obtainable in the glassy or amorphous state, for example those compositions taught in U.S. Pat. No. 3,856,513 and in prior art mentioned and discussed in that patent, as well as even other metastable alloy compositions apparently not hitherto prepared in a particulate amorphous state, such as $Mg_{70}Zn_{30}$, $Ta_{60}Ir_{30}B_{10}$, $Ti_{60}Ni_{30}Si_{10}$, $Mo_{80}Ru_{10}P_{10}$, etc.

As apparent from the drawing and description of the illustrated apparatus for carrying forth the method of the invention, the molten globules traverse a limited distance before contacting the rotating quenching fluid and thus also have limited exposure to the atmosphere surrounding the molten stream before breaking into particulates. Accordingly the oxidation characteristics of many metals and alloys do not limit their operability with the present invention. Materials known to be operable without the need for complete oxidation protection include the metals of iron, silver, nickel, tin, and zinc. Where it is desired to subject the molten globules to a particular atmosphere, then this atmosphere can be provided such as in the interior of an aforementioned and not illustrated containment vessel for apparatus 10. The method then can be carried out in an inert atmosphere or even at reduced pressure. If the molten globules have a significant vapor pressure, the composition and pressure of the gas within the containment vessel can be manipulated so as to reduce evaporation and maintain globule integrity until the globules contact quenchant. Alternatively in lieu of a containment vessel, a separate conduit, not illustrated, may be used to provide a desired gas environment in the vicinity of the place of the formation of the globules as well as the path they descend to contact the rapidly moving quenchant. Metals desirably employed with an atmosphere to reduce oxidation include titanium, niobium, tantalum, zirconium, magnesium, aluminum and molybdenum. Also, although not illustrated, in place of the illustrated flame 20 and torch 21, one would employ other means for heating and providing the molten globules including heating means such as electron beam heating, arc melting, laser beam heating, induction coil heating, other torches such as oxy-hydrogen and oxy-acetylene torches, and like conventional heating means.

At the conclusion of a run and removing of the mix of formed particulates and quenching fluid from the cup-shaped element or drum, the quenching fluid is separated by conventional means such as decanting, filtering, centrifuging, washing, etc. from the particulates which may be cleaned by washing, etc. and then separated by conventional means into various shapes, sizes, and classes of particulates. Useful for such separation are conventional sieves, precision sieves, roll tables, microparticle classifiers, etc.

BEST MODE OF CARRYING OUT THE INVENTION

The best mode presently known for carrying out the invention is illustrated by the foregoing description of the apparatus in the drawing and its operation and also is demonstrated in the following illustrative examples. However, since the examples are laboratory scale practices, the full benefits and advantages to be derived upon scale up to commercial practice and to commercial particulate products are expected to be of much greater value.

IN THE EXAMPLES

In the illustrative examples, which follow, there is employed a laboratory apparatus of the general description and nature of that shown in FIG. 1. The cup-shaped element of the employed apparatus is of aluminum, has an internal diameter averaging about 6.5 inches (16.5 cm.), a height of about 2 inches (5.08 cm.), and is capable of containing liquid quenchant in amounts up to 200 ml. and more. The motor means driving the shaft of the cup-shaped element is a 0.5 HP electrical motor whose speed can be varied and set at a desired constant steady speed by the electrical input thereto which is regulated by a controller.

Procedurally the desired amount of the liquid quench fluid (i.e. quench liquid) is placed in the cup-shaped element and this element rotated at a desired speed and also a speed adequate to position the liquid quench fluid as a centrifugally disposed ring of liquid clinging to the inner wall of the cup-shaped element. A solid rod or bar of the material to be made into fine particulates then is positioned with its one end directly over the path traversed by a lower portion of the rotatably moving centrifugally disposed ring of liquid quench fluid. A heat means, such as specified and generally a propane torch flame, is then used with for example the torch's flame focused on a lower end portion of the bar or rod and the heat means, e.g. torch's flame, adjusted so that molten globules of material drip and/or fall downward from the bar or rod to contact the rotatably moving centrifugally disposed ring of liquid quench fluid. Upon a molten globule contacting the quench fluid, there is heard a loud explosive-type sound and the globule appears to disintegrate into very fine fragments which are picked up and whisked along in the rotatably moving centrifugally disposed ring of liquid quench fluid. Within the quenchant, the fragments or particulates are subjected to extremely rapid cooling, and even cooling of an order requisite to provide particulates of a metallic glassy or other metastable or crystalline form depending on the size of the particle which in turn apparently depends on the temperature and velocity or speed of the quenching fluid and the temperature and size of the dropped molten globule.

EXAMPLE A

A bar of substantially pure tin of square cross-section of 0.25 in. (0.645 cm.) on a side and about 4 to 5 in. (10.16 to 12.7 cm.) length is employed as the material to be made into fine particulates. Water is used as the quench fluid (about 150 ml.) and the cup-shaped element rotated at about 10,000 rpm. or in the order of 4,000 ft./min. (~1400 m./min.). A propane gas torch is used and its flame is directed onto the lowermost end of the tin bar, which end was disposed inside of and approximately 0.4 in. (1 cm.) directly overhead of the lowermost inner portion of the rotatably moving centrifugally disposed ring of liquid water. The water was at room temperature of about 68° F. (20° C.) at the start. The rotatably moving centrifugally disposed ring of water was moving in a substantially vertical plane. The torch's flame upon bringing the end of the tin bar to a molten state provided a dripping therefrom of molten globules of tin approximately 0.125 in. (3.18 mm.) in diameter. The molten globules upon striking the high-speed water provided an explosive sound. After operating for a short period of time, the torch's flame was discontinued; the rotation of the cup-shaped element ceased; and a mix of water and fine solid particulates drained from the cup-shaped element. After evaporation of water from the fine solid particulates, the particulates were observed to be predominantly of flake-like shape and with a significant fraction of the produced tin particulates of −325 mesh size (U.S. Sieve Series).

EXAMPLE B

Varied additional preparations are made from bars and/or rods of cross-sectional areas from 0.016 sq. in (0.103 cm.$^2$) to 1 sq. in. (6.45 cm.$^2$) of solid source materials of zinc, lead, titanium, $Fe_{40}Ni_{40}P_{14}B_6$ and an aluminum alloy which in weight percent consists essentially of 4.4% Cu, 1.5% Mg, 0.6% Mn, and balance Al, using selected liquid quench fluids selected from water, automotive motor oil, a quench oil for metal heat treating such as Houghton K-oil which is of a mineral oil base containing oxide inhibitors and which meets Military Specification MIL-H-6875D, and cup-shaped element rotating speeds of 2500 to 10,000 rpm., and with molten globule distance to rotatably moving centrifugally disposed liquid quenchant of from 0.25 in. (0.645 cm.) to 1 in. (2.54 cm.). In each run fine solid particulates of a size less than one-hundredth of the volume of the molten globule are prepared.

As is apparent from the foregoing illustrative examples, solid particulates of flake, as well as spherical and irregular shapes and of various sizes can be prepared from a diversity of materials in their molten state. For example, water as the quenchant favors flake and sphere-type particulate formation, while oil as the quenchant favors production of particulates predominantly spherical or near spherical particulates. These shapes and sizes subsequently are separable and classifiable, as desired, into various fractions of particular shape and/or range of sizes. These particulate fractions find utility in many applications, such as in powder metallurgical applications wherein they can be consolidated by conventional techniques into useful articles, or they can be used as a feed stock powder for plasma spraying, or as elemental or alloy powder for the preparation of alloys otherwise difficult to make by conventional means, or as particulates in magnetic tapes, and the like.

We claim:

1. A method of making solid fine particulates from a normally solid material, which at a temperature within 25 percent of its equilibrium melting point °K has a surface tension in the range of 10 to 2500 dynes/cm. and a viscosity in the range of 0.001 to 1 poise when a molten material, comprising the steps of:

(a) heating an unconfined portion of a mass of the solid material to a molten state so as to permit droplets of molten material to fall therefrom;

(b) providing a moving ring-like mass of a centrifugally disposed rotating liquid quench fluid;

(c) positioning said portion subjected to heating and said moving ring-like mass in relation to each other that the droplets of molten material fall into contact with said moving ring-like mass of the centrifugally disposed rotating liquid quench fluid;

(d) breaking said droplets through said contact into fragments and cooling said fragments into solid fine particulates by said moving ring-like mass of the centrifugally disposed rotating liquid quench fluid; and (e) subsequently separating the solid fine particulates from the liquid quench fluid.

2. The method of claim 1 in which the moving ring-like mass travels at a speed of at least 3750 ft./min.

3. The method of claim 2 including a providing of an inert gas environment in the immediate vicinity of said molten state of the solid mass and the droplets of molten material.

4. The method of claim 2 in which the unconfined portion of the mass of the normally solid material is tin.

5. The method of claim 4 employing water as said liquid quench fluid.

6. The method of claim 2 in which the breaking of said droplets into said fragments is at least one hundredfold.

7. A method of preparing solid fine particulates from a normally solid material, which at a temperature within 25 percent of its equilibrium melting point °K has a surface tension in the range of 10 to 2500 dynes/cm. and a viscosity in the range of 0.001 to 1 poise when a molten material, comprising the steps of:

(a) disintegrating a molten globule of the solid material into fragments of less than one-hundredth of the volume of the molten globule through the molten globule contacting a moving ring-like mass of a centrifugally disposed rotating liquid quench fluid; and (b) quenching and cooling said fragments into solid fine particulates by the fragments being swept up and wisked into the moving ring-like mass of the centrifugally disposed rotating liquid quench fluid; and (c) subsequently separating the solid fine particulates from the liquid quench fluid.

8. The method of claim 7 employing the normally solid material which is a metal or metal alloy and in which the rapidly moving ring-like mass travels at a speed of at least 3750 ft./min.

9. The method of claim 8 including a providing of an inert gas environment in the vicinities of said disintegrating and of the molten globule.

10. A method of claim 9 which employs titanium or a titanium-base alloy for the normally solid material.

* * * * *